US009360281B1

(12) United States Patent
De Gaglia

(10) Patent No.: US 9,360,281 B1
(45) Date of Patent: Jun. 7, 2016

(54) RAPIDLY DEPLOYING BALLISTIC BARRIER CURTAIN

(71) Applicant: John De Gaglia, Coral Springs, FL (US)

(72) Inventor: John De Gaglia, Coral Springs, FL (US)

( * ) Notice: Subject to any disclaimer, the term of this patent is extended or adjusted under 35 U.S.C. 154(b) by 0 days.

(21) Appl. No.: 14/852,504

(22) Filed: Sep. 12, 2015

Related U.S. Application Data

(63) Continuation-in-part of application No. 14/019,515, filed on Sep. 5, 2013, now Pat. No. 9,134,097.

(60) Provisional application No. 61/697,386, filed on Sep. 6, 2012.

(51) Int. Cl.
*F41H 5/24* (2006.01)

(52) U.S. Cl.
CPC ..... *F41H 5/24* (2013.01)

(58) Field of Classification Search
CPC ..... F41H 5/24; F41H 5/007; F41H 3/02; F41H 13/0006
USPC ..... 89/36.01, 36.02, 36.03, 36.04, 36.05, 89/36.07, 36.15
See application file for complete search history.

(56) References Cited

U.S. PATENT DOCUMENTS

| | | | |
|---|---|---|---|
| 4,442,780 | A | 4/1984 | Child |
| 4,549,464 | A | 10/1985 | Hawkins et al. |
| 5,578,784 | A | 11/1996 | Karr et al. |
| 5,649,466 | A | 7/1997 | Genovese |
| 5,867,257 | A | 2/1999 | Rice et al. |
| 6,029,558 | A | 2/2000 | Stevens et al. |
| 6,266,926 | B1 | 7/2001 | Figge et al. |
| 6,279,449 | B1 | 8/2001 | Ladika et al. |
| 6,470,784 | B1 | 10/2002 | Bonavita et al. |
| 6,595,102 | B2 | 7/2003 | Stevens et al. |
| 6,666,124 | B2 | 12/2003 | Fleming |
| 7,178,445 | B2 | 2/2007 | Wulvik et al. |
| 7,421,936 | B2 | 9/2008 | Barger et al. |
| 7,458,321 | B2 | 12/2008 | Bornstein et al. |
| 7,963,075 | B2 | 6/2011 | Howland |
| 8,061,258 | B2 | 11/2011 | Hoadley et al. |
| 8,082,970 | B2 | 12/2011 | Gower |
| 8,281,702 | B2 | 10/2012 | Hoadley et al. |
| 8,479,432 | B2 | 7/2013 | Braun |
| 8,539,875 | B1 | 9/2013 | Hoadley et al. |

(Continued)

FOREIGN PATENT DOCUMENTS

| | | |
|---|---|---|
| JP | 06221796 | 8/1994 |

*Primary Examiner* — Benjamin P Lee
(74) *Attorney, Agent, or Firm* — Allen D.Hertz, P.A.; Allen D. Hertz

(57) ABSTRACT

A ballistic barrier curtain deployment system deploys a ballistic resistive curtain using a deployment firing mechanism. The ballistic barrier curtain can protect military personnel, equipment, diplomats, celebrities, etc. The deployment firing mechanism utilizes an inflator unit that operates using the same principles as an airbag inflator. The curtain is stored in a barrier curtain storage channel. The deployment firing mechanism is located in a ballistic barrier curtain deployment mechanism integrated at each end of the storage channel. A curtain deployment support column extends vertically from the curtain deployment mechanism. Each edge of the curtain is supported by the support column. The inflator unit is activated upon an activation request from a visual monitor, an audible monitor, heat/thermal monitor, or a manual directive. The inflator unit drives each edge of the curtain vertically, deploying the curtain between the support columns.

21 Claims, 14 Drawing Sheets

(56) References Cited

U.S. PATENT DOCUMENTS

| | | | |
|---|---|---|---|
| 8,677,881 | B2 | 3/2014 | Tillotson et al. |
| 8,788,218 | B2 | 7/2014 | Soles et al. |
| 8,857,310 | B2 | 10/2014 | Raiser |
| 2002/0152881 | A1 | 10/2002 | Stevens et al. |
| 2008/0216416 | A1 | 9/2008 | Leano |
| 2009/0132098 | A1 | 5/2009 | Leshem |
| 2009/0158954 | A1 | 6/2009 | Wardecki et al. |
| 2010/0319524 | A1 | 12/2010 | Farinella et al. |
| 2011/0204145 | A1 | 8/2011 | Odhner et al. |
| 2011/0239850 | A1 | 10/2011 | Raiser |
| 2012/0036990 | A1 | 2/2012 | Braun |
| 2013/0016449 | A1 | 1/2013 | Crandall |

RAPIDLY DEPLOYING BALLISTIC BARRIER CURTAIN

CROSS-REFERENCE TO RELATED APPLICATION

This Non-Provisional Utility Patent Application is a Continuation-In-Part claiming the benefit of U.S. Non-Provisional patent application Ser. No. 14/019,515, filed on Sep. 5, 2013 (issuing as U.S. Pat. No. 9,134,097 on Sep. 15, 2015), which claims the benefit of U.S. Provisional Patent Application Ser. No. 61/697,386 filed on Sep. 6, 2012, both of which are incorporated herein in their entireties.

FIELD OF THE INVENTION

The present disclosure generally relates to a ballistic barrier curtain for protecting individuals. More particularly, the present disclosure relates to a ballistic curtain deployment system for rapidly deploying a ballistic barrier curtain using an actuator comprising airbag deployment technology to protect individuals, including speakers, politicians, celebrities, military combatants, and the like.

BACKGROUND OF THE INVENTION

Certain conditions can expose an individual or a plurality of individuals to potential harm from a ballistic/explosives attack from snipers, assassins, enemy combatants, insurgents, and the like. Key individuals, such as dignitaries, controversial speakers, celebrities, and the like are subject to unwarranted ballistic/explosives attacks. Deployed military personal are continuously subjected to hostile environments with a strong potential of a ballistic/explosives attack.

Currently, a targeted individual is whisked from the exposed setting to a safer location once the attack is initiated. Unfortunately, the attacker is often awarded the advantage of a surprise, thus endangering the target with the initial action. The concerns regarding protecting the target is compounded, as the process of moving the targeted individual(s) takes time. The time could allow firing of multiple shots at the target, substantially increasing the risk of danger to the target.

Another known method of protecting a high-risk target is by placing the individual within a protective barrier, such as a ballistic proof vehicle, behind a ballistic proof barrier such as one or more sheets of polycarbonate resin thermoplastic. Placing the individual within or behind these barriers separates the individual from their audience.

Military combatants are continuously subjected to potential ballistic/explosives attacks. Military combatants are also continuously moving, and are therefore exposed to the potential dangers from exceedingly limited ballistic protection. Military combatants rely upon protective uniforms and accessories (such as helmets, vests, and the like) for protection from the ballistic/explosives attacks. Additional protection is provided by vehicles, structures, and the like. Each of these protective mechanisms has their own limitations.

Merchant sales clerks, bank tellers, and the like can be subjected to armed robberies. Some locations have ballistic-resistant barriers, such as thick sheets of polycarbonate resin thermoplastic located between the customer and the service person. This barrier introduces several limitations, including communications, transfer of items, and the like. A fixed barrier is impractical for conditions where the service person must handle merchandise, for procedures such as scanning a barcode for processing, and the like.

Therefore, what is needed for a barrier system that remains in a consolidated state until necessary, where the barrier is quickly deployed for protecting the targeted individual(s).

SUMMARY OF THE INVENTION

The present disclosure is generally directed to a rapid deploying ballistic barrier curtain system.

In some embodiments, the rapid deploying ballistic barrier curtain system may include:

a barrier curtain storage container having an opening located along an upper portion of a curtain storage section;

a set of ballistic barrier curtain deployment mechanisms, each ballistic barrier curtain deployment mechanism is in communication with a respective end of the barrier curtain storage container;

each ballistic barrier curtain deployment mechanism comprising:

- a curtain deployment support column having a curtain deployment element,
- at least one deployment firing mechanism in fluid communication with the curtain deployment support column,
- an activation controller in signal communication with each of the at least one deployment firing mechanism; and a ballistic barrier curtain having a first edge and a second edge, the first edge in operable communication with the first curtain deployment element and the second edge in operable communication with the second curtain deployment element, wherein in operation, the activation controller directs deployment of the at least one deployment firing mechanism, the at least one deployment firing mechanism discharges a rapid deploying gas which drives the respective ballistic barrier curtain edge towards a distal end of the curtain deployment support column, thus deploying the ballistic barrier curtain.

In another aspect, the deployment firing mechanism comprises functional elements of an airbag.

In yet another aspect, the curtain deployment support column is a rigid vertically oriented column.

In yet another aspect, the curtain deployment support column is a vertically oriented telescoping column.

In yet another aspect, the system can include an inflatable pole that is erected under the direct pressure generated by the initiator.

In yet another aspect, each ballistic barrier curtain deployment mechanism further comprises a primary deployment firing mechanism and a secondary deployment firing mechanism.

In yet another aspect, the rapid deploying ballistic barrier curtain system further comprises a remote control operating device.

In yet another aspect, the rapid deploying ballistic barrier curtain system further comprises a visual monitoring system for providing visual inputs to the operating device.

In yet another aspect, the rapid deploying ballistic barrier curtain system further comprises a heat/thermal monitoring system for providing identification of temperature differentiations that could be used to identify the launch of a projectile as an input to the device.

In yet another aspect, the rapid deploying ballistic barrier curtain system further comprises an audio monitoring system for providing audio inputs to the operating device.

In yet another aspect, the rapid deploying ballistic barrier curtain system further comprises a gas deterrent dispensing element for dispensing a deterrent gas. The deterrent gas can be smoke, colored smoke, fog, a noxious gas, tear gas, a flammable gas, and the like.

In yet another aspect, the rapid deploying ballistic barrier curtain system further comprises an audible deterrent dispensing element for emitting a noxious sound. The sound would be directed away from the potential target to distract audience members, allowing the potential target time to relocate.

In yet another aspect, the deployment system can include a deployment member attached to each respective curtain side edge.

In yet another aspect, the deployment member is provided in a shape of a ring, wherein the ring is assembled about a vertically oriented column within the curtain deployment support column.

In yet another aspect, the deployment member comprises a plurality of rings.

In another aspect, the activation controller further comprises a wireless communication system.

In another aspect, the activation controller further comprises a directly wired, "hard-wired" controller mechanism. The wired communication can be provided by electrically conductive wires, optical communications (such as fiber-optic cabling), and the like.

In yet another aspect, the curtain deployment support column further comprises a deployment dampening system located at a distal end of thereof.

In yet another aspect, the deployment dampening system can include a dampening member, such as a spring, a dampening device (such as a shock absorbing device), and the like.

In yet another aspect, the curtain deployment support column further comprises an upper curtain support ring retention element located at a distal end of thereof.

In yet another aspect, the curtain deployment support column further comprises a column deployment distal stop at a distal end of thereof.

In yet another aspect, the curtain deployment support column further comprises a firing exhaust port located at a distal end of thereof.

The rapid deploying ballistic barrier curtain system provides several advantages over the current art. The rapid deploying ballistic barrier curtain system provides a concealed ballistic protection system that can be quickly deployed. The deployment can be activated upon an audio detected event, a visually detected event, a manually requested deployment, and the like.

BRIEF DESCRIPTION OF THE DRAWINGS

The invention will now be described, by way of example, with reference to the accompanying drawings in which.

Like reference numerals refer to like parts throughout the several views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
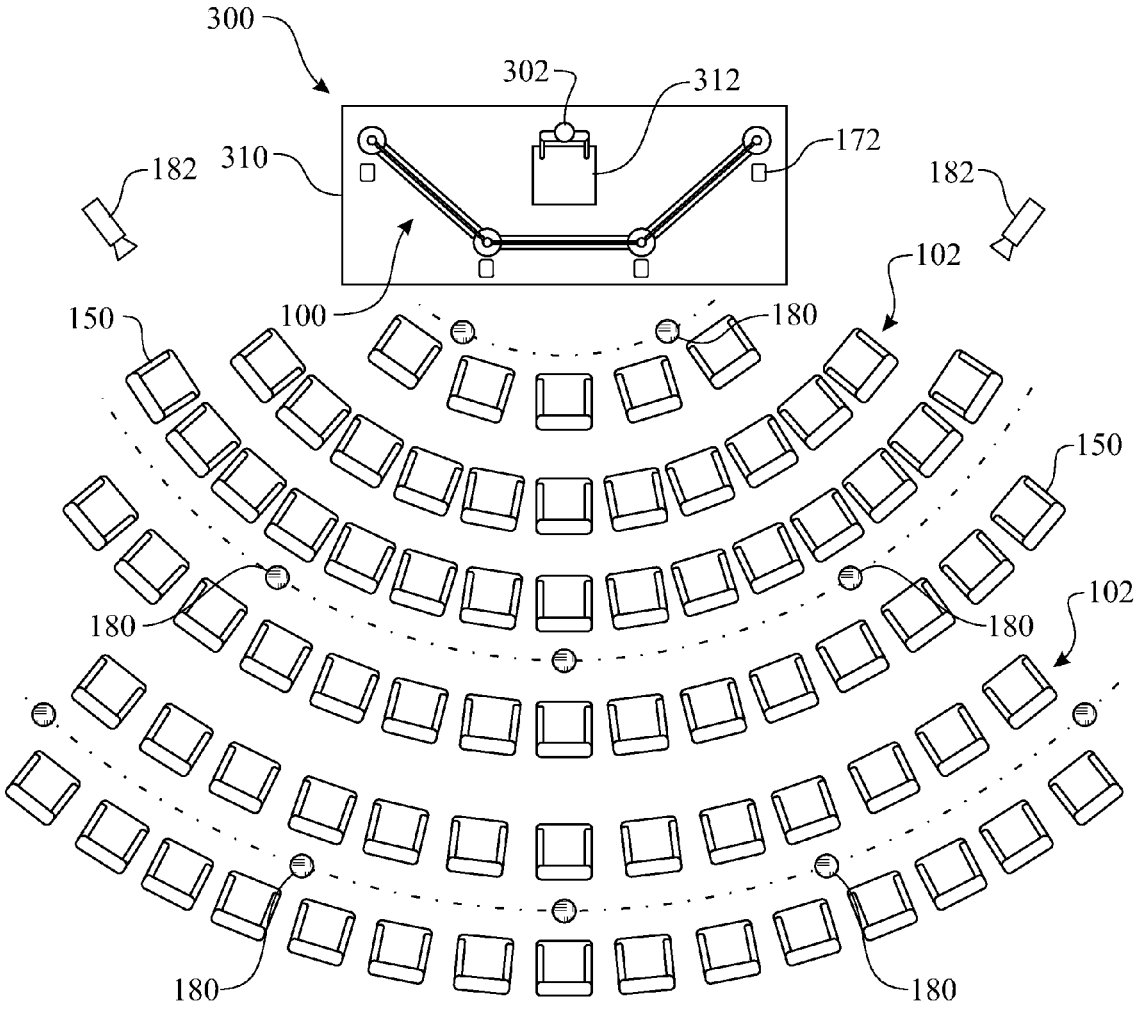
FIG. 1 presents a top plan view of an exemplary rapid deploying ballistic barrier curtain system deployed in a venue.

A ballistic barrier curtain deployment system 100 can be employed for protection of one or more individuals or objects in any of many environments, such as within a venue as illustrated in FIG. 1. The ballistic barrier curtain deployment system 100 can be used to protect dignitaries, military personnel, merchants, bank employees, and the like. The ballistic barrier curtain deployment system 100 enables unencumbered relations between the potential target and the general public, while providing protection to the potential target upon identification of a concerning event.

The illustrated exemplary environment is an auditorium comprising a plurality of seats 150 for accommodating an audience 102. The plurality of seats 150 is arranged orienting the audience 102 facing a speaker 302. The ballistic barrier curtain deployment system 100 is placed to at least partially surround the speaker 302. The ballistic barrier curtain deployment system 100 would be arranged to provide a barrier between the speaker 302 and the audience 102, ensuring that the speaker 302 is protected from any potential shooting location within the audience 102. In a preferred configuration, a ballistic protective stage 300 is provided to support the ballistic barrier curtain deployment system 100 and the speaker 302. The exemplary ballistic protective stage 300 includes a platform 310, elevating the speaker 302 above a floor for improved visibility of the speaker 302 by the audience 102. The platform 310 additionally supports a podium 312. The podium 312 can be fabricated of a ballistic resistant material to help protect the speaker 302.

Figure 2:
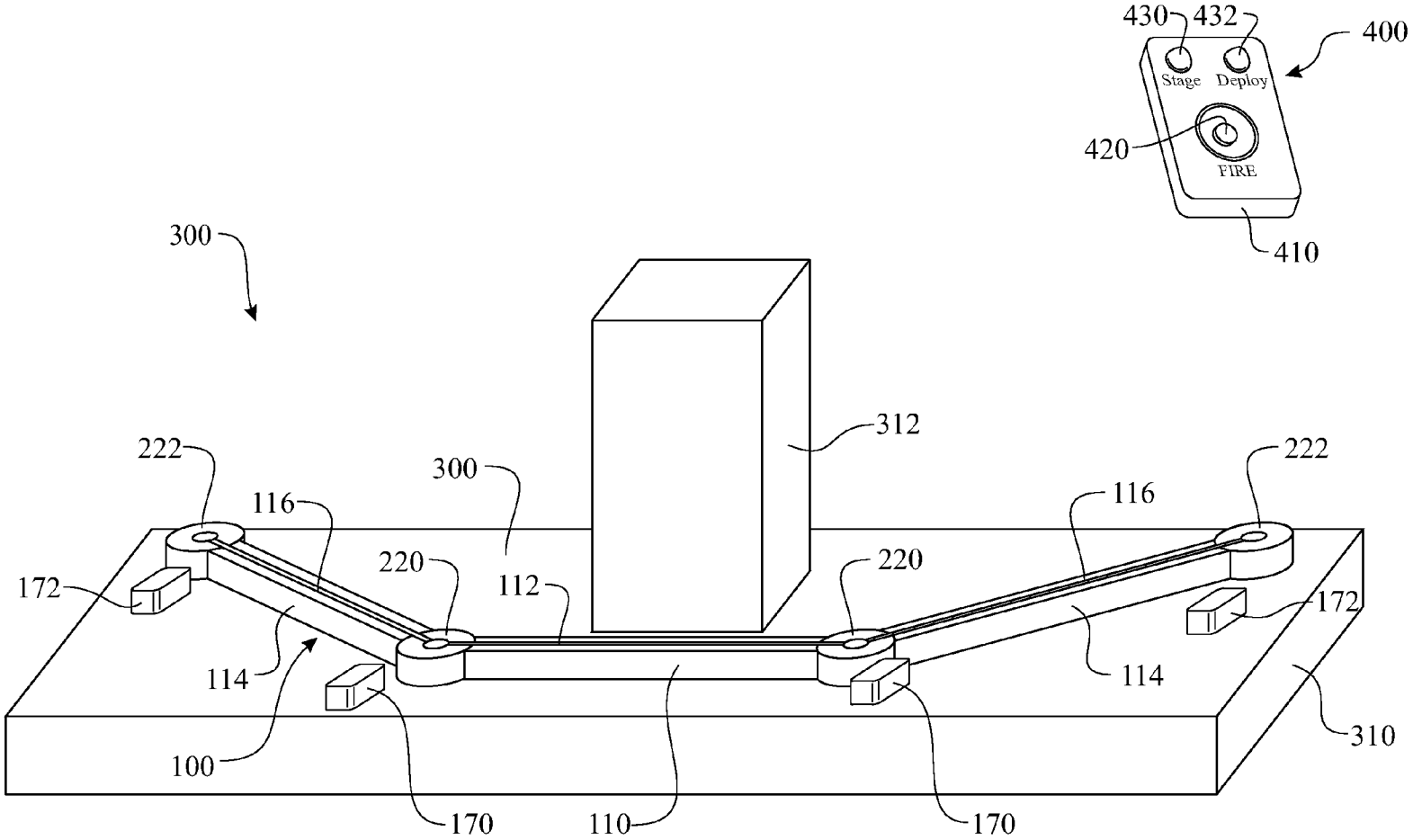
FIG. 2 presents an isometric front view of the rapid deploying ballistic barrier curtain system deployed on a stage, wherein the rapid deploying ballistic barrier curtain system is illustrated in a staged configuration.
Figure 3:
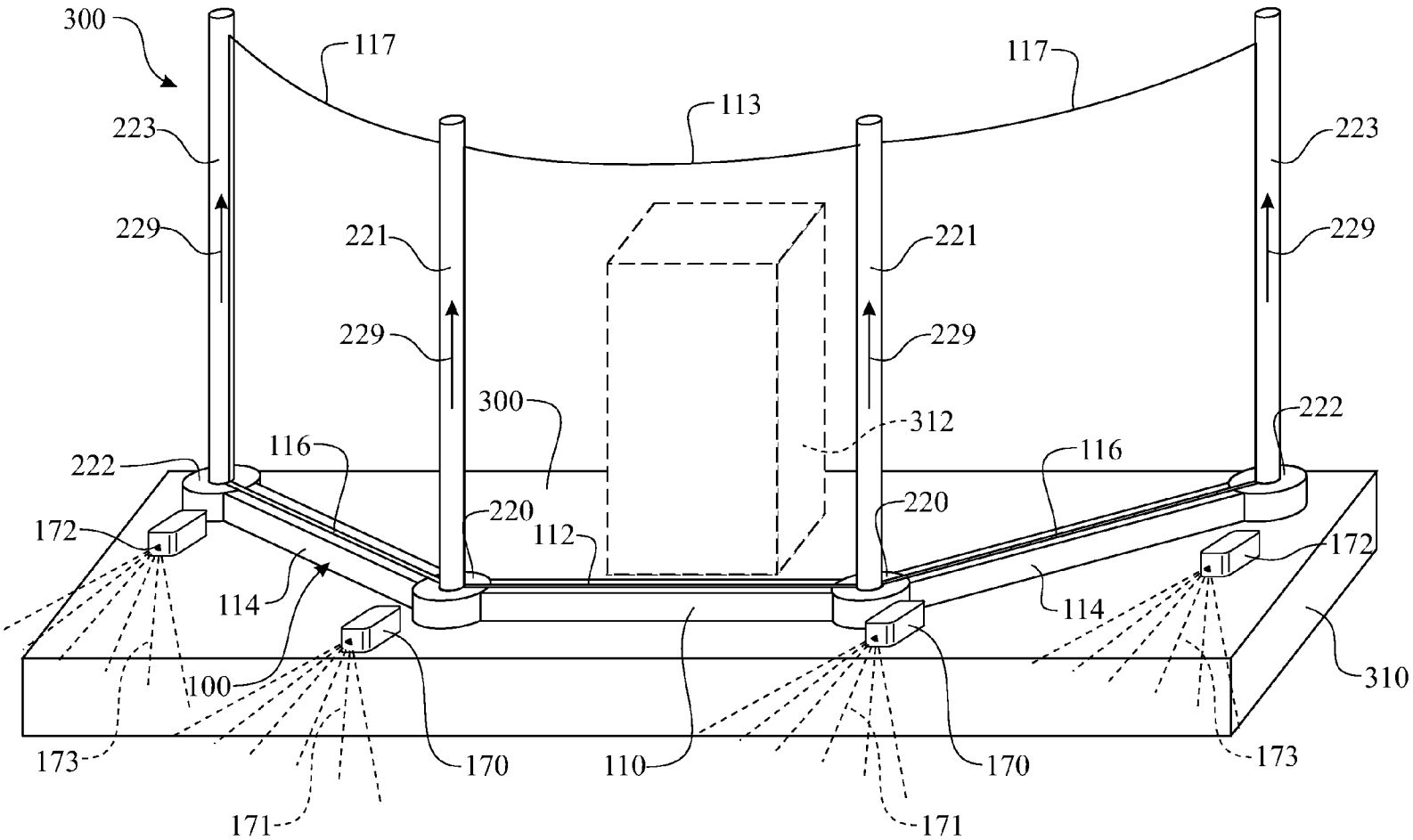
FIG. 3 presents an isometric front view of the rapid deploying ballistic barrier curtain system deployed on a stage, wherein the rapid deploying ballistic barrier curtain system is illustrated in a deployed configuration.

Details of the ballistic barrier curtain deployment system 100 are presented in FIGS. 1 through 3. The ballistic barrier curtain deployment system 100 includes at least one barrier curtain storage container 110, 114. Each barrier curtain storage container 110, 114 includes a curtain storage section for storing a ballistic barrier curtain 113, 117 therein and a barrier curtain storage channel 112, 116 enabling deployment of the ballistic barrier curtain 113, 117 from within the curtain storage section. The barrier curtain storage container 110, 114 would be sized and shaped to adequately store and transport the ballistic barrier curtain 113, 117. The ballistic barrier curtain(s) 113, 117 would be fabricated of a pliant, ballistic-resistant material, such as any fabric woven from aramid fiber, which includes material sold under the trade names NOMEX, KEVLAR, and the like. It is understood that the ballistic barrier curtain deployment system 100 can include a plurality of ballistic barrier curtains 113, 117 arranged as a series of layers to ensure any ballistic projectiles are stopped. One exemplary embodiment of a layered curtain configuration is presented in FIG. 8, where a redundant ballistic barrier curtain 123 is located in a parallel configuration with the primary ballistic barrier curtain 113. Alternatively, the ballistic protective stage 300 can include a plurality of ballistic barrier curtain deployment systems 100 arranged to provide the series of layers, such as the exemplary configuration presented in FIG. 9. A redundant ballistic barrier curtain deployment systems 101 can be deployed in parallel with the ballistic barrier curtain deployment systems 100.

Several additional system support elements can be deployed in the auditorium, including an audio monitoring system 180, a visual monitoring system 182, a thermal detection system, and a gas deterrent dispensing element central gas deterrent dispensing element 170 (FIGS. 2, 3), 172. The deterrent system can be modified to present either in conjunction with or alternatively to the gas, a light emitting system, a noxious noise emitting system, and the like. These elements can provide monitoring support to monitor for and determine when a deployment condition arises, provide additional protection for a potential target, and the like. Details will be described later herein.

The ballistic barrier curtain deployment system 100 includes a central ballistic barrier curtain deployment mechanism 220 located at each end of a central barrier curtain storage container 110. The ballistic barrier curtain deployment system 100 can be expanded to include at least one side barrier curtain storage container 114. Each side barrier curtain storage container 114 would be integrated into the central ballistic barrier curtain deployment mechanism 220 at a first end and would include a side ballistic barrier curtain deployment mechanism 222 at a second, opposite end thereof. The central ballistic barrier curtain deployment mechanism 220, 222 would be configured to support one or two curtains, based upon the application.

The 220, 222 includes a deployment system that raises the ballistic barrier curtain(s) 113, 117 in accordance with a curtain deploying motion 229. Each vertical edge of the ballistic barrier curtain(s) 113, 117 is supported by a curtain deployment support column 221, 223. The deployment extends the vertical edge of the ballistic barrier curtain(s) 113, 117 along a length of each curtain deployment support column 221, 223. The ballistic barrier curtain(s) 113, 117 would be retained by one or more curtain retention members.

The ballistic barrier curtain deployment system 100 can be provided in any of a variety of configurations. A first exemplary configuration utilizes a central ballistic barrier curtain deployment mechanism 220, which is detailed in FIGS. 2 through 5. A second exemplary configuration utilizes a ballistic barrier curtain deployment mechanism 520, which is detailed in FIGS. 6 through 8. The central ballistic barrier curtain deployment mechanism 220 and ballistic barrier curtain deployment mechanism 520 include a number of like elements Like features of the ballistic barrier curtain deployment mechanism 520 and central ballistic barrier curtain deployment mechanism 220 are numbered the same except preceded by the numeral '5'. A third exemplary configuration utilizes a ballistic barrier curtain deployment mechanism 620, which is detailed in FIGS. 10 through 13. The central ballistic barrier curtain deployment mechanism 220 and ballistic barrier curtain deployment mechanism 620 include a number of like elements. Like features of the ballistic barrier curtain deployment mechanism 620 and central ballistic barrier curtain deployment mechanism 220 are numbered the same except preceded by the numeral '6'.

Figure 4:
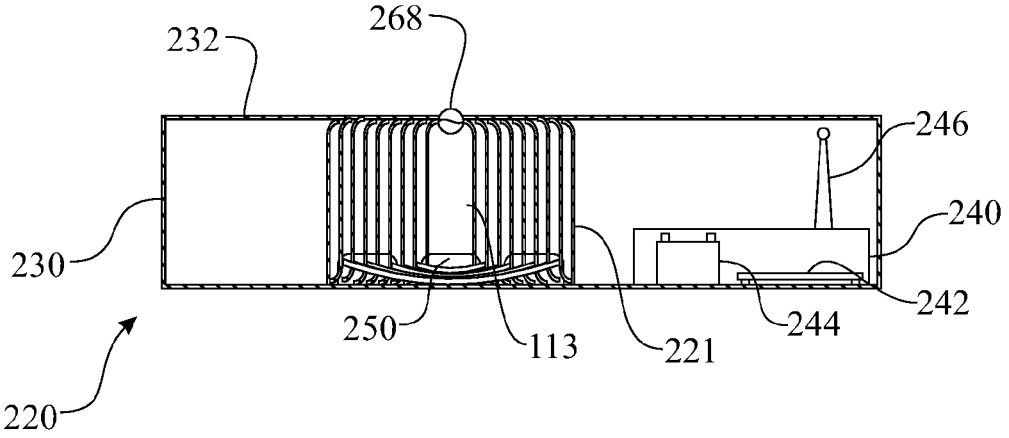
FIG. 4 presents a sectioned elevation view of a first exemplary ballistic barrier curtain deployment mechanism, wherein the ballistic barrier curtain deployment mechanism is illustrated in a staged configuration.
Figure 5:
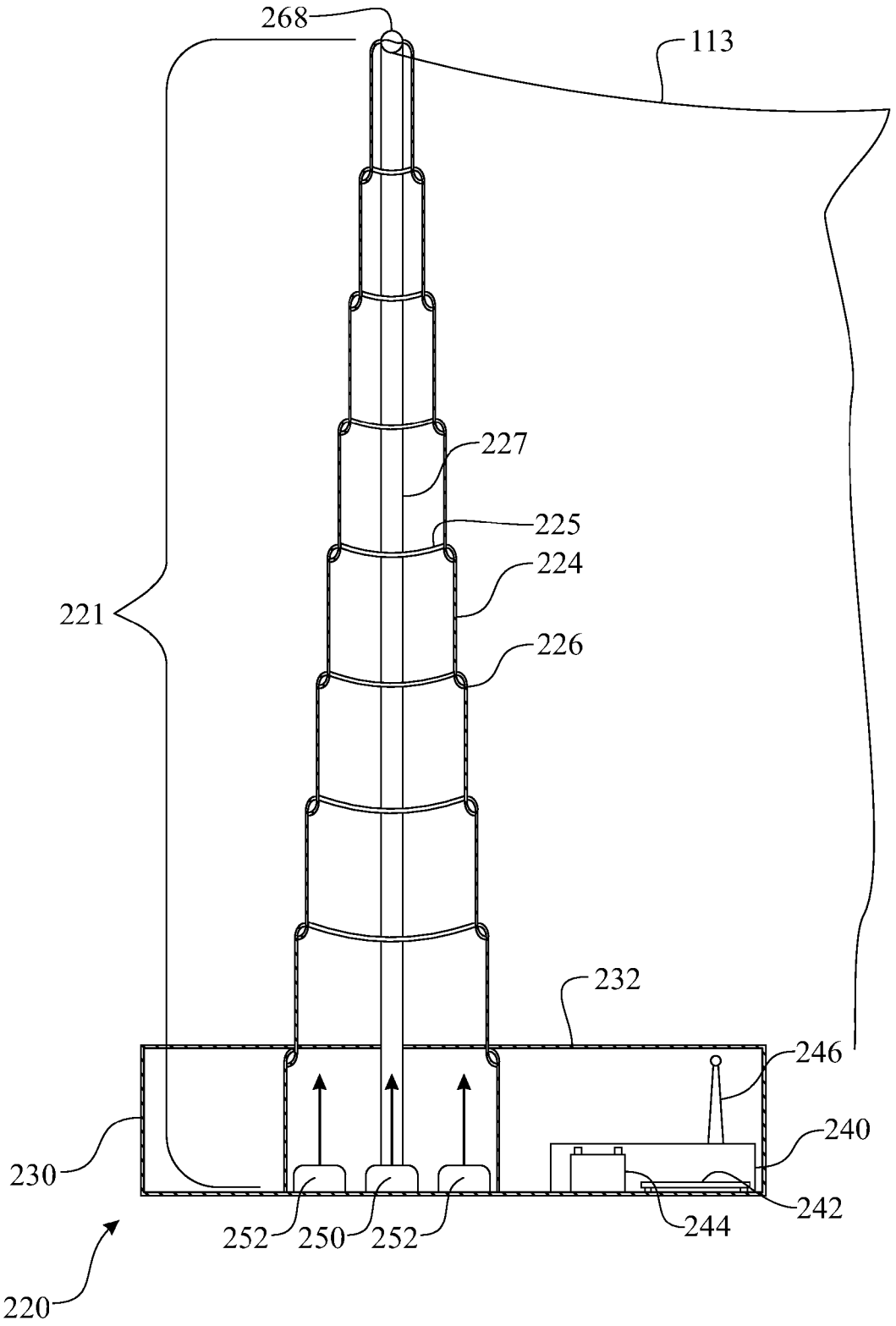
FIG. 5 presents a sectioned elevation view of the first exemplary ballistic barrier curtain deployment mechanism, wherein the ballistic barrier curtain deployment mechanism is illustrated in a deployed configuration.

Details of the ballistic barrier curtain deployment mechanism 220, 222 are presented in exemplary illustration of central ballistic barrier curtain deployment mechanism 220 shown in FIGS. 4 and 5. The central ballistic barrier curtain deployment mechanism 220 includes operational elements carried by a deployment mechanism enclosure 230. The deployment mechanism enclosure 230 can be defined having a deployment enclosure upper surface 232 and a deployment enclosure base surface 234. An activation controller 240 provides a communication interface from or between a remote activation device and includes circuitry for directing and controlling deployment of the ballistic barrier curtain 113, 117. The activation controller 240 can include an activation controller printed circuit assembly 242 comprising the operational controlling circuitry, communication circuitry, power management circuitry, and the like. Electrical power is provided to the ballistic barrier curtain deployment system 100 for operating the electrical components. Electrical power can be provided by an external power source or, preferably, by integrated a portable power source 244 within the activation controller 240. The portable power source 244 is preferably included enabling autonomy and portability of the ballistic barrier curtain deployment system 100. The activation controller printed circuit assembly 242 includes circuitry to direct deployment of the central curtain deployment support column 221 and respective central ballistic barrier curtain 113, 117. A wireless communication interface 246 can be integrated into the activation controller 240 to provide communication of the activation controller printed circuit assembly 242 with a remote activation device. It is understood that the system can utilize a wired interface in place of or as a redundant system to the wireless communication interface.

The ballistic barrier curtain 113, 117 is deployed by activating at least one deployment firing mechanism 250, 252. The at least one deployment firing mechanism 250, 252 includes components similar to an airbag. It is preferred that the ballistic barrier curtain deployment mechanism 220 can include a primary deployment firing mechanism 250 and at least one redundant deployment firing mechanism 252 to ensure proper deployment when needed.

When the ballistic barrier curtain 113, 117 is to deploy, a signal is sent to an inflator unit or the primary deployment firing mechanism 250 integrated within the deployment mechanism enclosure 230. An igniter starts a rapid chemical reaction generating primarily nitrogen gas (N2) to fill the central curtain deployment support column 221 making it deploy from the deployment enclosure upper surface 232 of the deployment mechanism enclosure 230. Some airbag technologies use compressed nitrogen or argon gas with a pyrotechnic operated valve ("hybrid gas generator"), while other technologies use various energetic propellants. Propellants containing the highly toxic sodium azide (NaN3) were common in early inflator designs.

The azide-containing pyrotechnic gas generators contain a substantial amount of the propellant. The driver-side airbag would contain a canister containing about 50 grams of sodium azide. The passenger side container holds about 200 grams of sodium azide.

The alternative propellants may incorporate, for example, a combination of nitroguanidine, phase-stabilized ammonium nitrate (NH4NO3) or other nonmetallic oxidizer, and a nitrogen-rich fuel different than azide (e.g. tetrazoles, triazoles, and their salts). The burn rate modifiers in the mixture may be an alkaline metal nitrate (NO3-) or nitrite (NO2-), dicyanamide or its salts, sodium borohydride (NaBH4), etc. The coolants and slag formers may be e.g. clay, silica, alumina, glass, etc. Other alternatives are e.g. nitrocellulose based propellants (which have high gas yield but bad storage stability, and their oxygen balance requires secondary oxidation of the reaction products to avoid buildup of carbon monoxide), or high-oxygen nitrogen-free organic compounds with inorganic oxidizers (e.g., di or tricarboxylic acids with chlorates (ClO3-) or perchlorates (ClO4-) and eventually metallic oxides; the nitrogen-free formulation avoids formation of toxic nitrogen oxides).

From the onset of the directive for activation, the entire deployment process is estimated to be about 0.04 seconds. This rapid deployment minimizes the time between a triggering event and deployment, thus significantly reducing any potential of a ballistic projectile impacting the protected individual, plurality of individuals, or object.

The deployment process expands a gas. The gas raises the ballistic barrier curtain 113, 117. The ballistic barrier curtain 113, 117 would be carried by an element that is raised by the expanding gas.

In one embodiment, the curtain raising element would comprise a series of telescoping column segments 224, wherein each telescoping element would be spatially attached along a length of the respective vertical curtain edge. Each telescoping column segment 224 includes a telescoping column segment extension aperture 225 at a first end and a curtain support channel 227 proximate a second, opposite end. The telescoping column segments 224 would telescope axially upon expansion of the activated combination of gases. The telescoping column segment extension limiter 226 engages with the telescoping column segment extension aperture 225 to limit the movement of each of the telescoping column segments 224. A deployment stop element 268 would be located at the distal end of the central curtain deployment support column 221. The deployment stop element 268 can include a vent or other pressure relief mechanism to avoid potential damage to the central curtain deployment support column 221 from the expanding gas.

Figure 6:
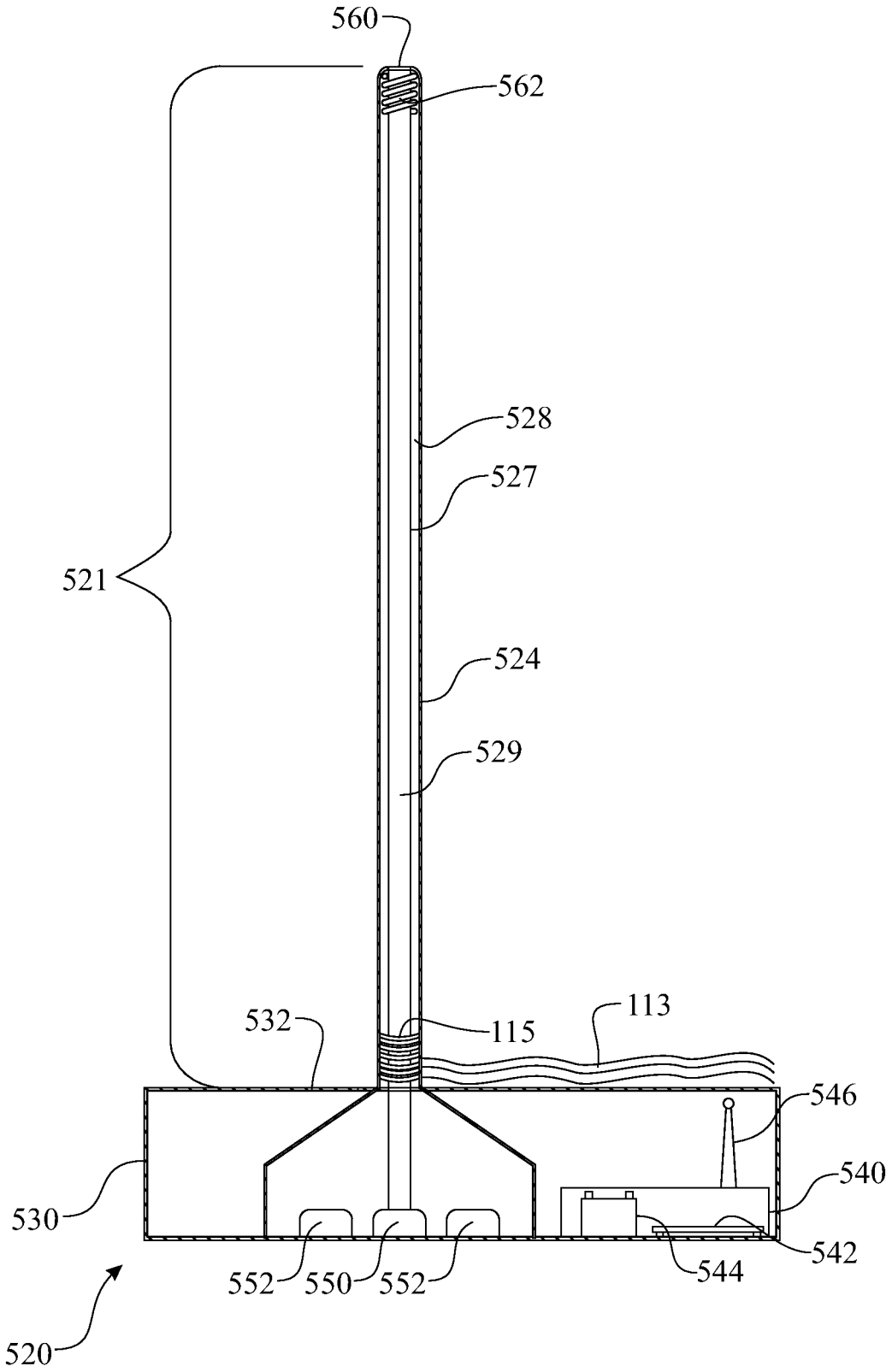
FIG. 6 presents a sectioned elevation view of a second exemplary ballistic barrier curtain deployment mechanism, wherein the ballistic barrier curtain deployment mechanism is illustrated in a staged configuration.
Figure 7:
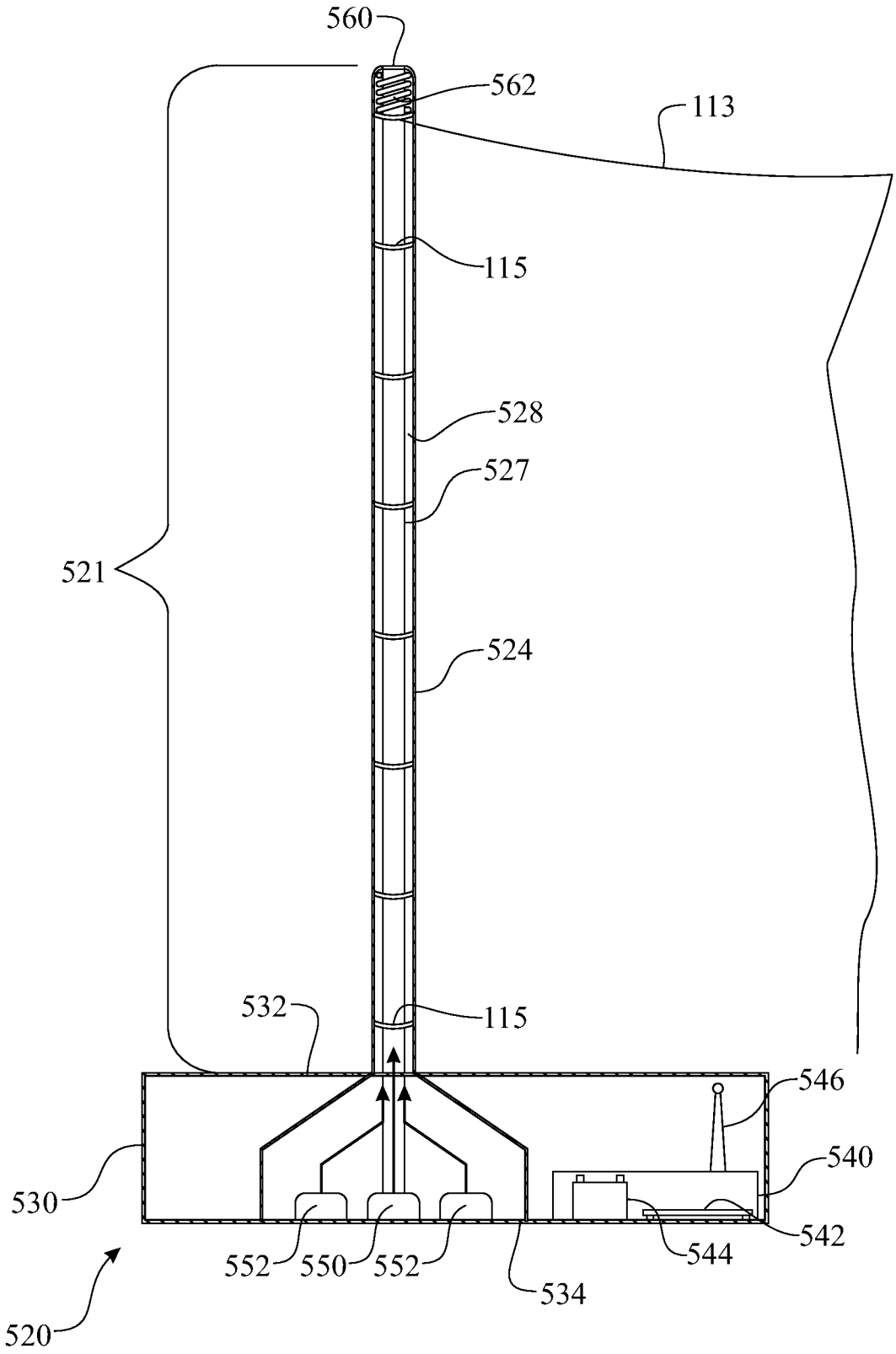
FIG. 7 presents a sectioned elevation view of the second exemplary ballistic barrier curtain deployment mechanism, wherein the ballistic barrier curtain deployment mechanism is illustrated in a deployed configuration.
Figure 8:
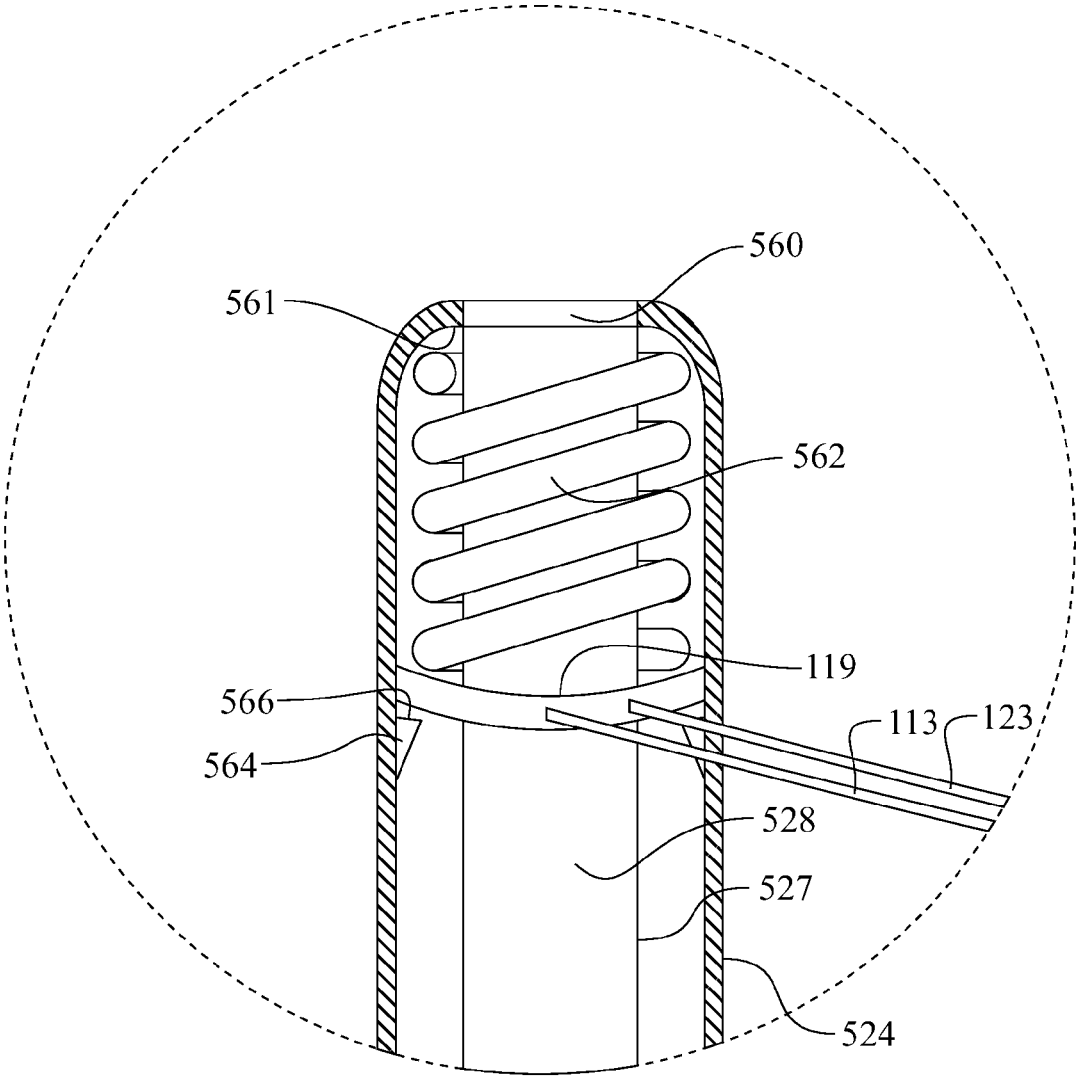
FIG. 8 presents an enlarged sectioned elevation view of a deployment dampening portion of the second exemplary ballistic barrier curtain deployment mechanism.
Figure 9:
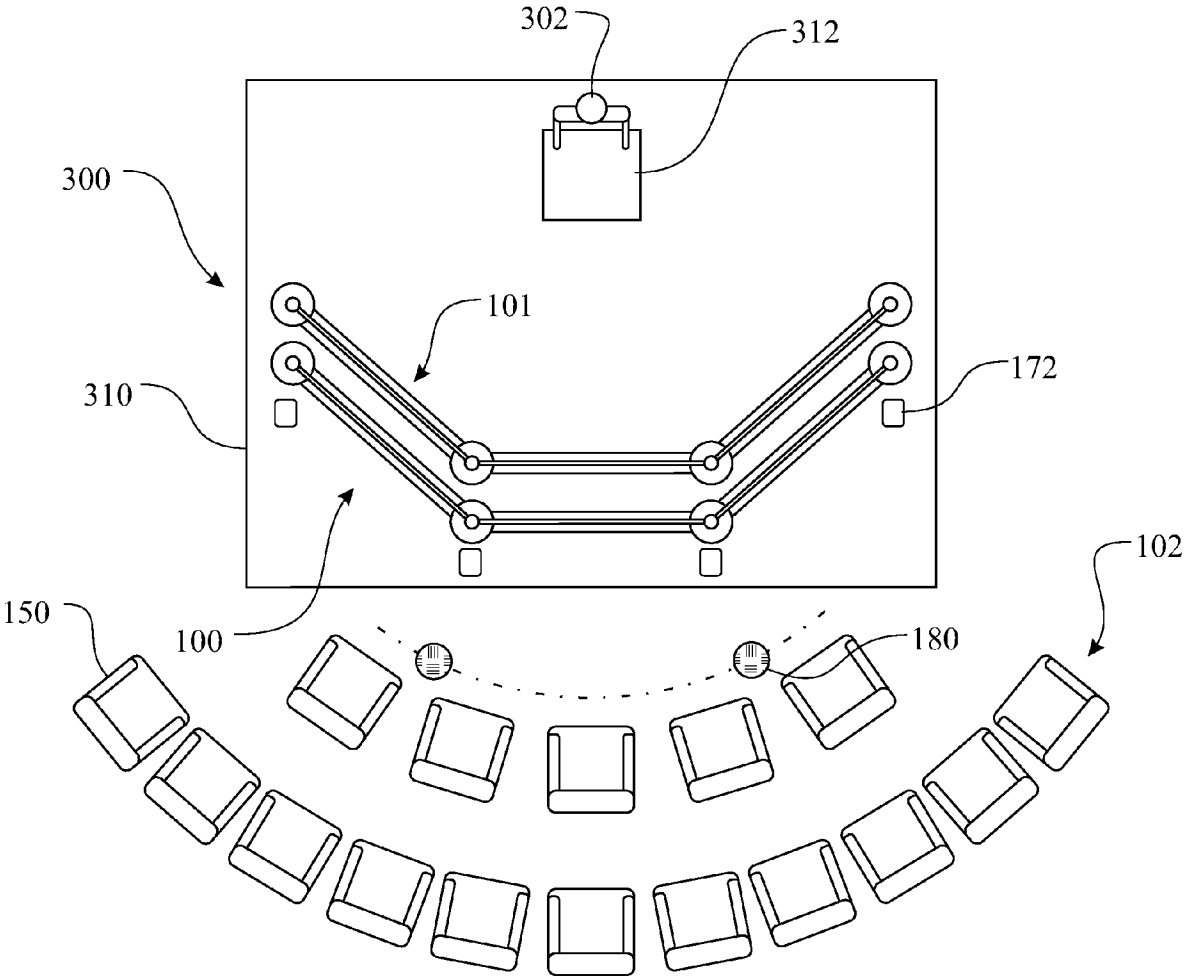
FIG. 9 presents a top plan view of the exemplary rapid deploying ballistic barrier curtain system deployed in a venue and introduces a redundant rapid deploying ballistic barrier curtain system.
Figure 10:
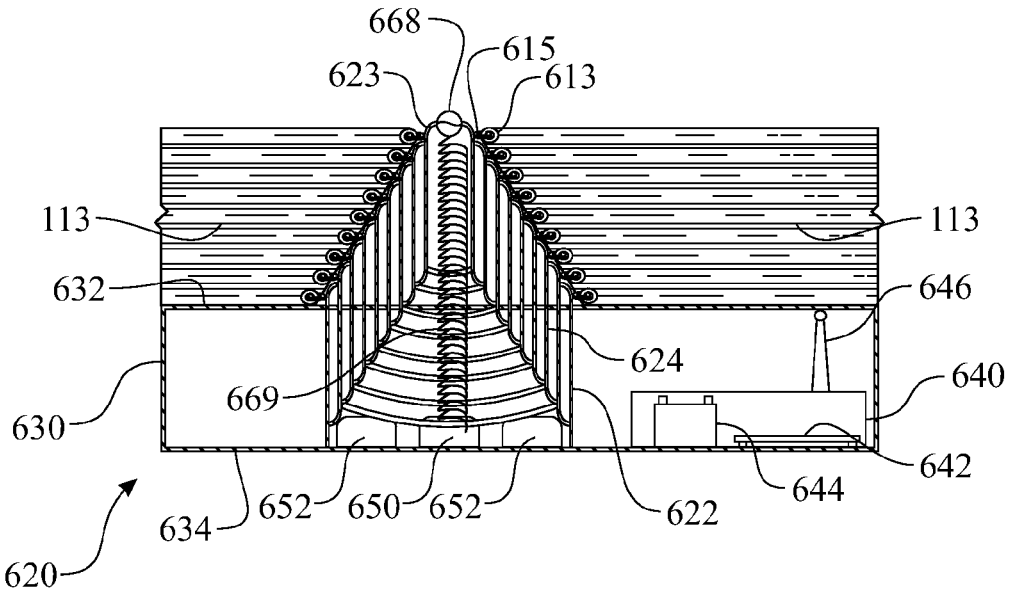
FIG. 10 presents a sectioned elevation front view of a variant of the telescoping rapid deploying ballistic barrier curtain system, wherein the ballistic barrier curtain system is shown in a pre-staged, collapsed configuration.
Figure 11:
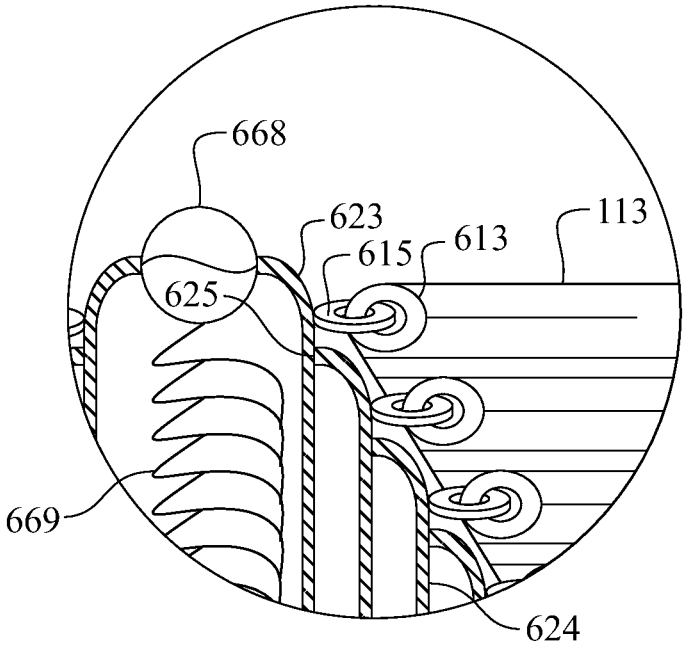
FIG. 11 presents a magnified sectioned elevation view of an upper portion of the telescoping rapid deploying ballistic barrier curtain system originally introduced in FIG. 10.

In another embodiment, the curtain raising element would comprise a series of curtain deployment support rings 115 as illustrated in FIGS. 6 through 8. The curtain deployment support rings 115 would slide axially along a curtain support column 527. The curtain support column 527 would be encased within a tubular column 524. A deployment firing tunnel 528 would be formed between an exterior surface of the curtain support column 527 an interior surface of the tubular column 524. The expanding gas would be directed into the deployment firing tunnel 528 by a deployment force collector 536. The tubular column 524 is preferably fabricated of rigid tubular material. A deployment feature can be integrated into the distal ring 119. The deployment feature would be designed to engage with the expanding gas, wherein the deployment feature would drive the vertical edge of the ballistic barrier curtain 113, 117 axially towards the distal end of the tubular column 524. A curtain deployment dampening member 562 can be assembled with an interior of the tubular column 524 and preferably seated against a column deployment distal stop 561. The curtain deployment dampening member 562 would be employed to de-accelerate the motion of the distal ring 119. It is understood that the configuration of the deployment firing tunnel 528 may vary. In one alternative example, the deployment firing tunnel 528 can be located within the curtain support column 527.

In another embodiment, the inflating poles may include a sealed tube for containment of the initiated gas allowing the curtain to be propelled upward. A pressure relief valve can be provided at a distal end of the inflating pole to discharge any excessive gas.

A upper curtain support ring retention element 564 can be integrated into the tubular column 524, wherein the upper curtain support ring retention element 564 enables the distal ring 119 to pass across the upper curtain support ring retention element 564 during deployment, then retains the distal ring 119 in the desired position once the ballistic barrier curtain 113, 117 is in a deployed condition. The exemplary embodiment presents a biased wedge. The wedge would retract against a biasing force when the distal ring 119 passes the elongated tapered surface. The biasing element would return the wedge to a retaining configuration once the distal ring 119 passes thereby. The distal ring 119 would rest upon a retention element ring support surface 566 of the upper curtain support ring retention element 564. The tubular column 524 can include a firing exhaust port 560 for venting any excess expanding gas to avoid potential damage to the central curtain deployment support column 221 from the expanding gas.

The ballistic barrier curtain deployment mechanism 620 is similar to the ballistic barrier curtain deployment mechanism 520 in design and operation. The telescoping column 621 includes a telescoping column base segment 622 located at a lower end thereof, a telescoping column cap segment 623 located at an upper end thereof, and at least one telescoping column intermediary segment 624 located therebetween. The ballistic barrier curtain deployment mechanism 620 introduces an attachment interface for attaching the ballistic barrier curtain 113 to the telescoping column 621. The telescoping column 621 is fabricated having a series of elements assembled in a collapsing or sleeved (FIGS. 10 and 12) and an expanded or telescoping (FIG. 13) configuration. An upper end of each telescoping element 623, 624 extends through a telescoping column segment extension aperture 625 of the immediately lower telescoping element 622, 624. A lower edge of each telescoping column intermediary segment 624 and the telescoping column cap segment 623 are formed to include a telescoping column segment extension limitor 626 about a lower edge thereof. The telescoping column segment extension limitor 626 is adapted to restrict an upward extension motion of the telescoping column intermediary segment 624 and the telescoping column cap segment 623 by engaging with the interior surface of the upper section of the immediately lower adjacent telescoping column intermediary segment 624 or telescoping column base segment 622. The axial length of each of the telescoping elements 623, 642 ensures an upper portion (an exposed portion) thereof remains proud of the upper surface of the immediately lower telescoping element 622, 624.

At least one column element of attachment assembly 615 is attached to the exposed portion of the telescoping column cap segment 623 and each respective telescoping column intermediary segment 624 as well as the upper section of the telescoping column base segment 622 (or a similar base attachment element) as illustrated. The column element of attachment assembly 615 can be of any suitable design, shape, and size for attaching the curtain element of attachment assembly 613 thereto. In the exemplary embodiment, each column element of attachment assembly 615 is formed as a ring and assembled to the respective exposed portion of the telescoping column cap segment 623 and each respective telescoping column intermediary segment 624.

The ballistic barrier curtain 113 is adapted and assembled to the telescoping column 621 to maintain the telescoping function of the telescoping column 621. At least one column element of attachment assembly 615 is joined to an upper region of each respective segment 622, 623, 624 of the telescoping column 621. A plurality of curtain element of attachment assemblies 613 are secured to the ballistic barrier curtain 113 in a spatial arrangement, preferably along a vertical edge thereof. The spatial distance between adjacent curtain element of attachment assemblies 613 is substantially similar to an axial length of each respective telescoping column intermediary segment 624. In one implementation, each curtain element of attachment assembly 613 can be an eyelet compressed through the material of the ballistic barrier curtain 113. In a second implementation, each curtain element of attachment assembly 613 can be a loop mechanically assembled to the material of the ballistic barrier curtain 113. It is understood that the attachment of the ballistic barrier curtain 113 to the base region of the telescoping column 621 can be accomplished in accordance with any suitable attachment mechanism and location.

Figure 12:
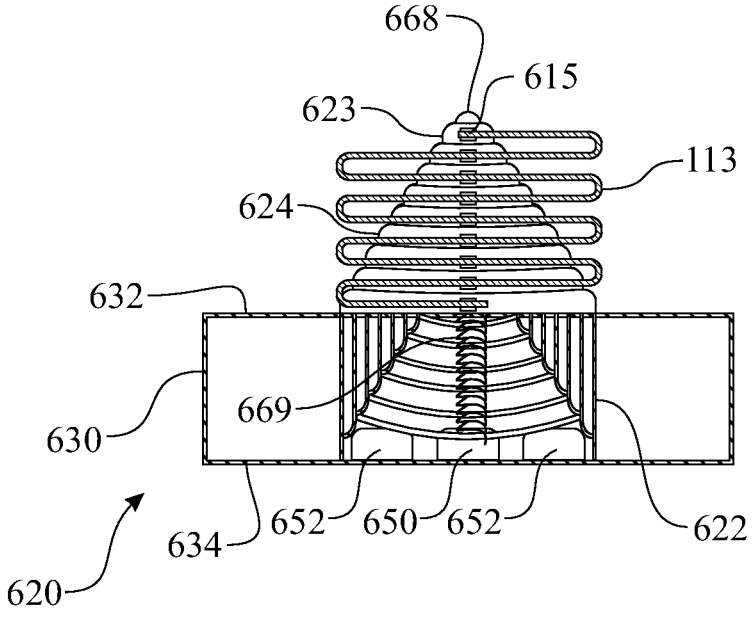
FIG. 12 presents a sectioned elevation transverse view of the telescoping rapid deploying ballistic barrier curtain system originally introduced in FIG. 10, wherein the telescoping rapid deploying ballistic barrier curtain system is shown in a pre-staged, collapsed configuration.

In a collapsed state, the ballistic barrier curtain 113 is preferably folded in a serpentine fashion, as best shown in FIG. 12. It is also understood that the ballistic barrier curtain 113 can comprising one or more layers or sheets to aid in capturing the ballistic projectile.

Figure 13:
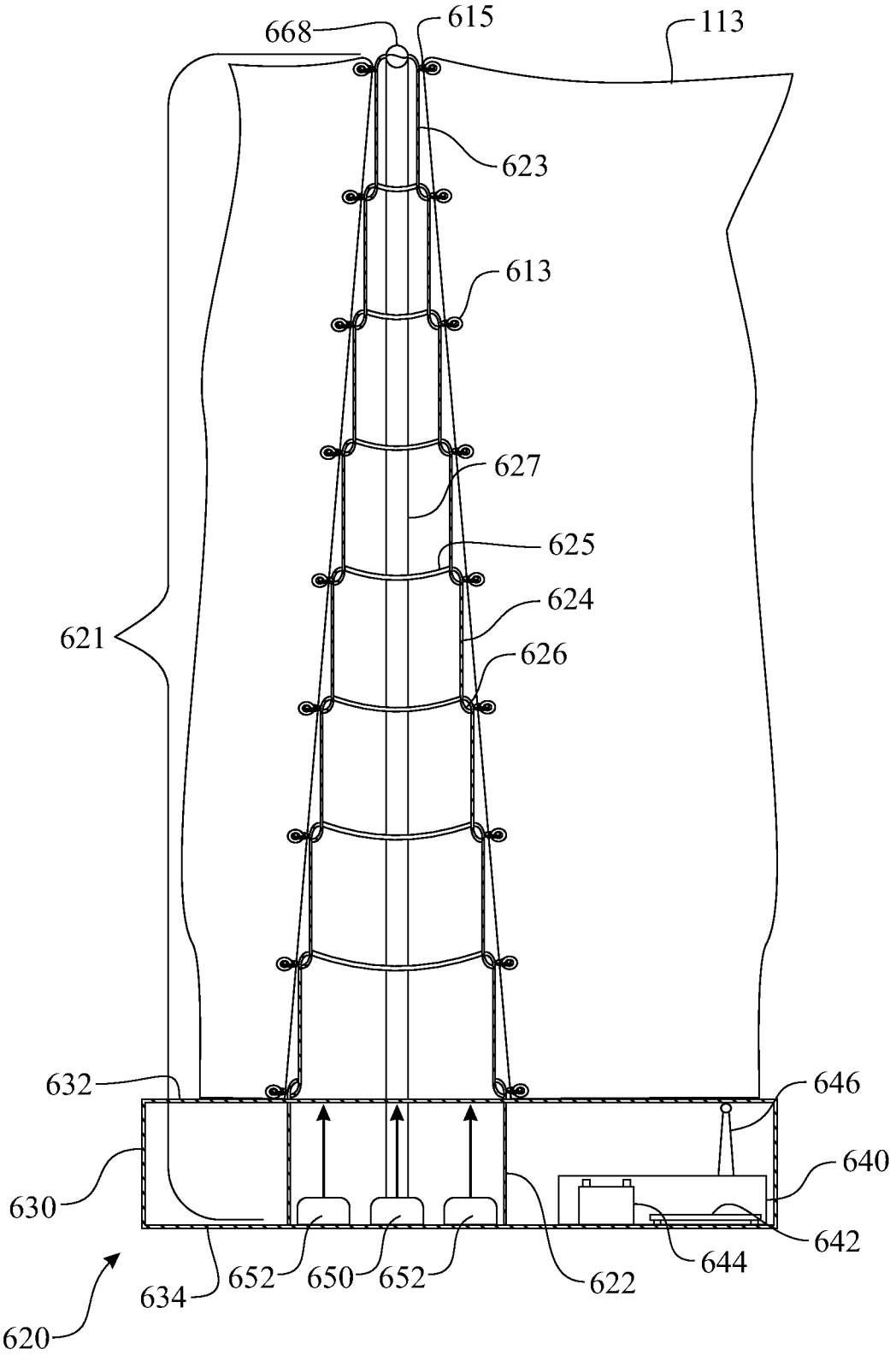
FIG. 13 presents a sectioned elevation front view of the telescoping rapid deploying ballistic barrier curtain system originally introduced in FIG. 10, wherein the ballistic barrier curtain system is shown in an expanded, deployed configuration.

In operation, the ballistic barrier curtain deployment mechanism 620 would be staged, having the telescoping column 621 placed into a collapsed state. The ballistic barrier curtain 113 would be folded in a serpentine fashion. The ballistic barrier curtain deployment mechanism 620 would be deployed in a strategic location for protecting at least one potential target. Upon receiving a signal from a detector, a activation controller 640 would activate each of the primary deployment firing mechanism 650 and the redundant deployment firing mechanism 652. Each of the primary deployment firing mechanism 650 and the redundant deployment firing mechanism 652 release a sufficient expanding volume of gas, extending the telescoping column 621 from the collapsed state (FIGS. 10 and 12) to a deployed, expanded state (FIG. 13). The expanding gas can be encased within the telescoping column 621 or within a curtain support channel 627 (FIG. 13) located internally to the telescoping column 621.

A deployment stop element tether 669 can be employed to aid in limiting the extension of the telescoping column 621. A first end of the deployment stop element tether 669 would be secured to a lower portion of the telescoping column 621 and a second, opposite end of the deployment stop element tether 669 would be secured to a deployment stop element 668. As the telescoping column 621 expands, the deployment stop element tether 669 is drawn taught, limiting an expanded length of the telescoping column 621. The expansion of the telescoping column 621 raises the ballistic barrier curtain 113. The raised ballistic barrier curtain 113 captures projectiles, such as bullets.

It is understood that the spatial attachment arrangement between the ballistic barrier curtain 113 and the telescoping column 621 can be adapted to any vertical support member configuration.

Figure 14:
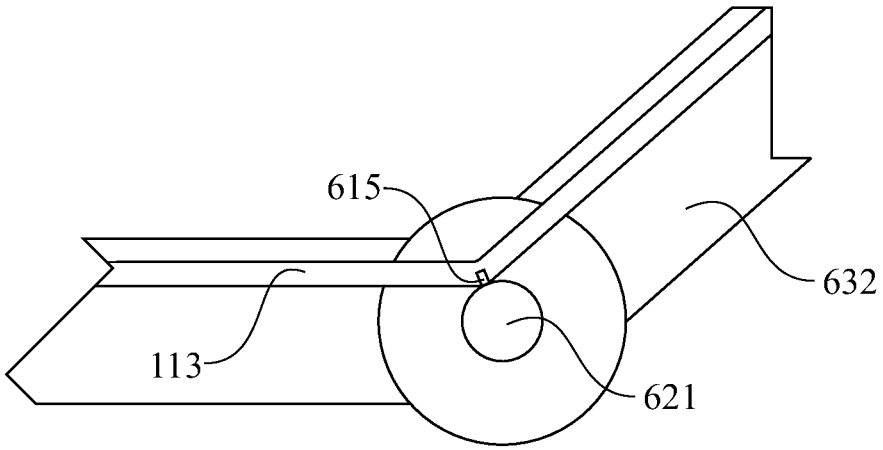
FIG. 14 presents a top plan view of a first alternative attachment configuration for attaching the central ballistic barrier curtain to the telescoping column, more specifically a attachment configuration attaching the central ballistic barrier curtain to an interior side of the telescoping column as defined by an angle therebetween.

The central ballistic barrier curtain 113 can be routed in any suitable arrangement for attachment to the telescoping column 621. By routing the central ballistic barrier curtain 113 as a continuous sheet around the telescoping column 621 to avoid exposure through any gaps that may be formed by the configuration best shown in FIG. 13. In a first configuration (illustrated in FIG. 14), the central ballistic barrier curtain 113 is continuous and routed about the telescoping column 621 on an interior side, wherein the interior side is defined by an angle formed by a bend of the central ballistic barrier curtain 113. The interior side is defined as the side of the assembly on the side where the angle formed by the bend of the central ballistic barrier curtain 113 is less than 180 degrees.

Figure 15:
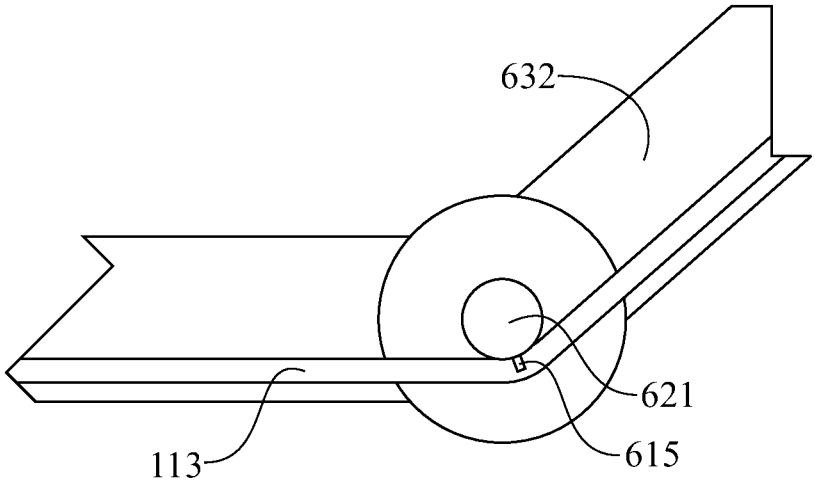
FIG. 15 presents a top plan view of a second alternative attachment configuration for attaching the central ballistic barrier curtain to the telescoping column, more specifically a attachment configuration attaching the central ballistic barrier curtain to an exterior side of the telescoping column as defined by the angle therebetween.

In a second configuration (illustrated in FIG. 15), the central ballistic barrier curtain 113 is continuous and routed about the telescoping column 621 on an exterior side, wherein the exterior side is defined by an angle formed by a bend of the central ballistic barrier curtain 113. The exterior side is defined as the side of the assembly on the side where the angle formed by the bend of the central ballistic barrier curtain 113 is greater than 180 degrees.

Figure 16:
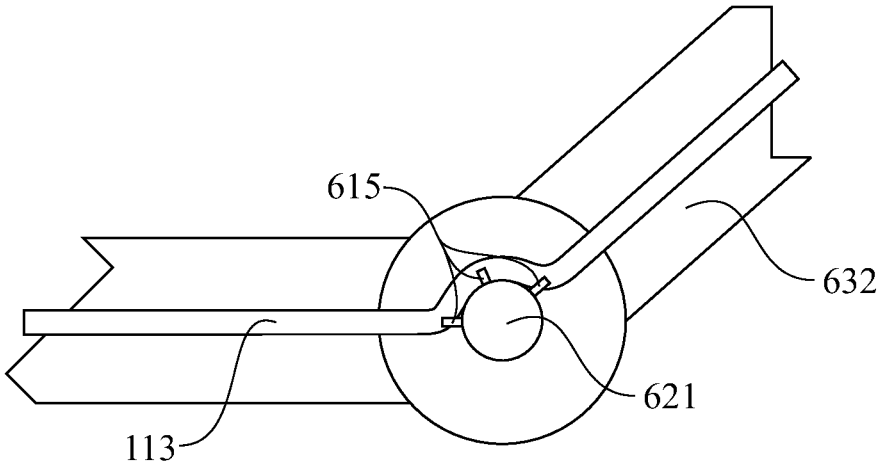
FIG. 16 presents a top plan view of a third alternative attachment configuration for attaching the central ballistic barrier curtain to the telescoping column, more specifically a attachment configuration attaching the central ballistic barrier curtain to a pair of sides and the interior side of the telescoping column as defined by an angle therebetween.

In a third configuration (illustrated in FIG. 16), the central ballistic barrier curtain 113 is continuous and routed about the telescoping column 621 on an interior side, as previously defined. The central ballistic barrier curtain 113 is attached to at least two locations about a circumference of the telescoping column 621. The multiple attachment points reinforces the assembly of the central ballistic barrier curtain 113 and the telescoping column 621 to one another. The multiple attachment points additionally distributes the forces subjected between the central ballistic barrier curtain 113 and the telescoping column 621, resulting in an improved vertical extension compared to the single attachment point of the first configuration.

Figure 17:
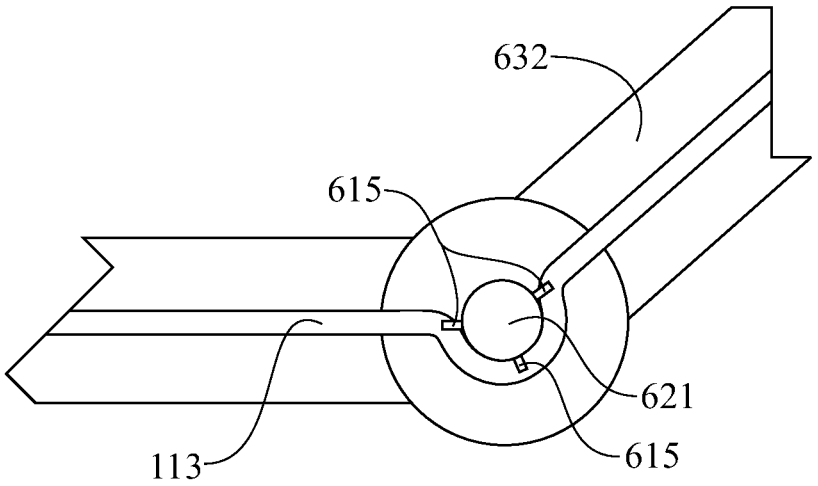
FIG. 17 presents a top plan view of a fourth alternative attachment configuration for attaching the central ballistic barrier curtain to the telescoping column, more specifically a attachment configuration attaching the central ballistic barrier curtain to a pair of sides and the exterior side of the telescoping column as defined by the angle therebetween.

In a fourth configuration (illustrated in FIG. 17), the central ballistic barrier curtain 113 is continuous and routed about the telescoping column 621 on an exterior side, as previously defined. The central ballistic barrier curtain 113 is attached to at least two locations about a circumference of the telescoping column 621. The multiple attachment points reinforces the assembly of the central ballistic barrier curtain 113 and the telescoping column 621 to one another. The multiple attachment points additionally distributes the forces subjected between the central ballistic barrier curtain 113 and the telescoping column 621, resulting in an improved vertical extension compared to the single attachment point of the first configuration.

A plurality of audio monitoring systems 180 can be spatially arranged throughout the auditorium to monitor for any unwarranted sounds. The system can monitor for unwarranted sounds, including motion, movement of a trigger, gunfire, and the like. A processing portion of each audio monitoring system 180 is preferably accomplished at the location of the audio monitoring system 180 to minimize time. In a condition where the audio monitoring system 180 detects an unwarranted sound, the audio monitoring system 180 would transmit a directive to the ballistic barrier curtain deployment system 100 to deploy.

At least one visual monitoring system 182 can be located within the auditorium to monitor for any unwarranted motion. The system can monitor for unwarranted motion, including a person standing and aiming a firearm at the speaker 302, and the like. A processing portion of each visual monitoring system 182 is preferably accomplished at the location of the visual monitoring system 182 to minimize time. In a condition where the visual monitoring system 182 detects an unwarranted motion, the visual monitoring system 182 would transmit a directive to the ballistic barrier curtain deployment system 100 to deploy.

At least one heat/thermal monitoring system can be located within the auditorium for detection of any unwarranted heat source, which would be assumed to indicate the launch of a projectile.

A barrier remote activator 400, introduced in FIG. 4, can be employed enabling manual deployment of the ballistic barrier curtain deployment system 100. The barrier remote activator 400 can communicate with the activation controller 240 using wired or wireless technology. The barrier remote activator 400 includes various features carried by an activator casing 410. The barrier remote activator 400 includes a staged status indicator 430 enabling the holder to manually direct deployment of the ballistic barrier curtain deployment system 100. The barrier remote activator 400 can include indicators to identify the condition of the ballistic barrier curtain deployment system 100. The indicators can include a staged status indicator 430 and a deployed status indicator 432 to inform the holder of the current condition of the ballistic barrier curtain deployment system 100.

At least one gas deterrent dispensing element 170, 172 can be positioned in a manner orienting a spray direction towards the audience 102. The at least one gas deterrent dispensing element 170, 172 can be employed to discharge a deterrent dispensed gas 171, 173. The deterrent dispensed gas 171, 173 can be smoke, colored smoke, fog, a noxious gas, tear gas, a flammable gas (preferably provided in a form of a controlled flame), and the like. The deterrent dispensed gas 171, 173 is discharged to provide any of several advantages to the speaker 302. One objective would be to obscure the speaker 302 from view of the audience 102. A second optional objective of the gas deterrent dispensing element 170, 172 would be to disorient the audience 102. A third optional objective of the gas deterrent dispensing element 170, 172 would be to dissuade the audience 102 from approaching the ballistic protective stage 300. The deterrent dispensed gas 171, 173 would be selected based upon the desired objective thereof.

The gas deterrent dispensing element 170, 172 can be modified to include strobing lights, bright lights, and the like to further distract and divert the attention of the audience from the targeted individual/speaker 302. It is understood that the gas deterrent dispensing element 170, 172 can be replaced with a unit that includes strobing lights, bright lights, and the like.

The gas deterrent dispensing element 170, 172 can be modified to include an apparatus to emit a noxious sound to further distract and divert the attention of the audience from the targeted individual/speaker 302. It is understood that the gas deterrent dispensing element 170, 172 can be replaced with a unit that includes the apparatus to emit a noxious sound.

The ballistic barrier curtain deployment system 100 can be placed upon a supporting surface, such as the ground, a deck of a platform 310, and the like. The deployment enclosure base surface 234 would be supported by the supporting surface. The ballistic barrier curtain deployment system 100 can be converted to a portable unit by attaching wheels to the deployment enclosure base surface 234. The wheels can be arranged to ensure adequate support of the ballistic barrier curtain deployment system 100 during transport and use.

The deployment firing mechanisms 250, 252, 550, 552 can utilize any rapid deployment mechanism. The preferred embodiment utilizes airbag technology. It is understood that as airbag technology advances, the same technology advances can be integrated into the deployment firing mechanisms 250, 252, 550, 552.

Although the exemplary concept is illustrated to protect a speaker in an auditorium, it is understood that the ballistic barrier curtain deployment system 100 can be employed to protect military personnel during combat, military equipment, diplomats and other political figures, celebrities, controversial persons/presenters, and the like.

Although the exemplary embodiment presents a system that deploys upwards, it is understood that the system may be mounted from above and deploy downward or even sideways as desired.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

REF. NO. DESCRIPTION

100 ballistic barrier curtain deployment system
102 audience
110 central barrier curtain storage container
112 central barrier curtain storage channel
113 central ballistic barrier curtain
114 side barrier curtain storage container
115 curtain deployment support rings
116 side barrier curtain storage channel
117 side ballistic barrier curtain
119 distal ring
123 redundant ballistic barrier curtain
150 seat
170 central gas deterrent dispensing element
171 deterrent dispensed gas
172 side gas deterrent dispensing element
173 side deterring disbursed gas
180 audio monitoring system
182 visual monitoring system
220 central ballistic barrier curtain deployment mechanism
221 central curtain deployment support column
222 side ballistic barrier curtain deployment mechanism
223 side curtain deployment support column
224 telescoping column segment
225 telescoping column segment extension aperture
226 telescoping column segment extension limitor
227 curtain support channel
268 deployment stop element
229 curtain deploying motion
230 deployment mechanism enclosure
232 deployment enclosure upper surface
234 deployment enclosure base surface
240 activation controller
242 activation controller printed circuit assembly
244 portable power source
246 wireless communication interface
250 primary deployment firing mechanism
252 redundant deployment firing mechanism
300 ballistic protective stage
302 speaker
310 platform
312 podium
400 barrier remote activator
410 activator casing
420 activation switch
430 staged status indicator
432 deployed status indicator
520 ballistic barrier curtain deployment mechanism
521 fixed curtain deployment support column
524 tubular column
527 curtain support column
528 deployment firing tunnel
529 curtain deploying motion
530 deployment mechanism enclosure
532 deployment enclosure upper surface
534 deployment enclosure base surface
536 deployment force collector
540 activation controller
542 activation controller printed circuit assembly
544 portable power source
546 wireless communication interface
550 primary deployment firing mechanism
552 redundant deployment firing mechanism
560 firing exhaust port
561 column deployment distal stop
562 curtain deployment dampening member
564 upper curtain support ring retention element
566 retention element ring support surface
613 curtain element of attachment assembly
615 column element of attachment assembly
620 ballistic barrier curtain deployment mechanism
621 telescoping column
622 telescoping column base segment
623 telescoping column cap segment
624 telescoping column intermediary segment
625 telescoping column segment extension aperture
626 telescoping column segment extension limitor
627 curtain support channel
629 curtain deploying motion
630 deployment mechanism enclosure
632 deployment enclosure upper surface
634 deployment enclosure base surface
640 activation controller
642 activation controller printed circuit assembly
644 portable power source
646 wireless communication interface
650 primary deployment firing mechanism
652 redundant deployment firing mechanism
668 deployment stop element
669 deployment stop element tether

What is claimed is:

1. A ballistic barrier curtain deployment system comprising:

a barrier curtain storage container having an opening located along an upper portion of a curtain storage section;

a set of ballistic barrier curtain deployment mechanism, each ballistic barrier curtain deployment mechanism in communication with a respective end of the barrier curtain storage container;

each ballistic barrier curtain deployment mechanism comprising:

a curtain deployment support column having an extending curtain deployment element, at least one deployment firing mechanism in fluid communication with the curtain deployment support column, an activation controller in signal communication with each of the at least one deployment firing mechanism; and a ballistic barrier curtain having a first vertical deploying attachment section and a second vertical deploying attachment section, the first vertical deploying attachment section in operable communication with a first extending curtain deployment element of a first barrier curtain deployment mechanism of the set of ballistic barrier curtain deployment mechanisms and a second vertical deploying attachment section in operable communication with a second extending curtain deployment element of a second barrier curtain deployment mechanism of the set of ballistic barrier curtain deployment mechanisms, wherein the attachment is provided by a plurality of attachment elements spatially arranged along the respective vertical deploying attachment section, wherein in operation, the activation controller directs deployment of the at least one deployment firing mechanism, the at least one deployment firing mechanism discharges a rapid deploying gas which drives the respective vertical deploying attachment section towards a distal end of the curtain deployment support column, thus deploying the ballistic barrier curtain.

2. A ballistic barrier curtain deployment system as recited in claim 1, further comprising a primary deployment firing mechanism and a secondary deployment firing mechanism, each of said primary deployment firing mechanism and said secondary deployment firing mechanism being in operational communication with a respective one of said set of ballistic barrier curtain deployment mechanisms.

3. A ballistic barrier curtain deployment system as recited in claim 1, further comprising an inflatable pole that is erected under the direct pressure generated by an initiator.

4. A ballistic barrier curtain deployment system as recited in claim 1, said at least one deployment firing mechanism further comprising a primary deployment firing mechanism and at least one redundant deployment firing mechanism.

5. A ballistic barrier curtain deployment system as recited in claim 1, further comprising a remote control operating device, wherein said remote control operating device is in signal communication with an activation controller to remotely operate said at least one deployment firing mechanism.

6. A ballistic barrier curtain deployment system as recited in claim 1, further comprising at least one of:

a visual monitoring system for providing visual inputs to the activation controller; and an audio monitoring system for providing audio inputs to the activation controller.

7. A ballistic barrier curtain deployment system as recited in claim 1, further comprising at least one of a heat monitoring system and a thermal monitoring system for providing identification of temperature differentiations that could be used to identify the launch of a projectile as an input to the activation controller.

8. A ballistic barrier curtain deployment system as recited in claim 1, further comprising a gas deterrent dispensing element for dispensing a deterrent gas, wherein said gas deterrent dispensing element dispenses a deterrent gas in conjunction with activation of said ballistic barrier curtain.

9. A ballistic barrier curtain deployment system as recited in claim 1, further comprising an audible deterrent emitting element for emitting a noxious sound, wherein said audible deterrent emitting element emits an audible deterrent in conjunction with activation of said ballistic barrier curtain.

10. A ballistic barrier curtain deployment system as recited in claim 1, wherein said barrier curtain storage container and said deployment mechanism enclosure are designed to be expandable, enabling interconnectivity between a plurality of alternating barrier curtain storage containers and said deployment mechanism enclosures.

11. A ballistic barrier curtain deployment system as recited in claim 1, wherein said barrier curtain storage container and said deployment mechanism enclosure are designed to be expandable, enabling interconnectivity between a plurality of alternating barrier curtain storage containers and said deployment mechanism enclosures.

12. A ballistic barrier curtain deployment system as recited in claim 1, wherein said ballistic barrier curtain is arranged into a serpentine configuration when the ballistic barrier curtain deployment system is in a staged configuration.

13. A ballistic barrier curtain deployment system comprising:

a barrier curtain storage container having an opening located along an upper portion of a curtain storage section;

a set of ballistic barrier curtain deployment mechanism, each ballistic barrier curtain deployment mechanism in communication with a respective end of the barrier curtain storage container;

each ballistic barrier curtain deployment mechanism comprising:

a curtain deployment support column having an extending curtain deployment element, a telescoping column comprising a series of nesting telescoping column segments;

at least one deployment firing mechanism in fluid communication with the curtain deployment support column, an activation controller in signal communication with each of the at least one deployment firing mechanism; and a ballistic barrier curtain having a first vertical deploying attachment section and a second vertical deploying attachment section, the first vertical deploying attachment section in operable communication with a first extending curtain deployment element of a first barrier curtain deployment mechanism of the set of ballistic barrier curtain deployment mechanisms and the second vertical deploying attachment section in operable communication with a second extending curtain deployment element of a first barrier curtain deployment mechanism of the set of ballistic barrier curtain deployment mechanisms, wherein the attachment is provided by a plurality of attachment elements spatially arranged along the respective vertical deploying attachment section, wherein in operation, the activation controller directs deployment of the at least one deployment firing mechanism, the at least one deployment firing mechanism discharges a rapid deploying gas which drives the respective vertical deploying attachment section towards a distal end of the curtain deployment support column, thus deploying the ballistic barrier curtain.

14. A ballistic barrier curtain deployment system as recited in claim 12, further comprising a primary deployment firing mechanism and a secondary deployment firing mechanism, each of said primary deployment firing mechanism and said secondary deployment firing mechanism being in operational communication with a respective one of said set of ballistic barrier curtain deployment mechanisms.

15. A ballistic barrier curtain deployment system as recited in claim 12, said at least one deployment firing mechanism further comprising a primary deployment firing mechanism and at least one redundant deployment firing mechanism.

16. A ballistic barrier curtain deployment system as recited in claim 12, further comprising a remote control operating device, wherein said remote control operating device is in signal communication with an activation controller to remotely operate said at least one deployment firing mechanism.

17. A ballistic barrier curtain deployment system as recited in claim 12, further comprising at least one of:

a visual monitoring system for providing visual inputs to the activation controller; and an audio monitoring system for providing audio inputs to the activation controller.

18. A ballistic barrier curtain deployment system as recited in claim 12, further comprising at least one of a heat monitoring system and a thermal monitoring system for providing identification of temperature differentiations that could be used to identify the launch of a projectile as an input to the activation controller.

19. A ballistic barrier curtain deployment system as recited in claim 12, further comprising a gas deterrent dispensing element for dispensing a deterrent gas, wherein said gas deterrent dispensing element dispenses a deterrent gas in conjunction with activation of said ballistic barrier curtain.

20. A ballistic barrier curtain deployment system as recited in claim 12, further comprising an audible deterrent emitting element for emitting a noxious sound, wherein said audible deterrent emitting element emits an audible deterrent in conjunction with activation of said ballistic barrier curtain.

21. A ballistic barrier curtain deployment system as recited in claim 12, wherein said ballistic barrier curtain is arranged into a serpentine configuration when the ballistic barrier curtain deployment system is in a staged configuration.

* * * * *